US012173445B2

(12) United States Patent
Lee et al.

(10) Patent No.: US 12,173,445 B2
(45) Date of Patent: Dec. 24, 2024

(54) WASHING MACHINE

(71) Applicant: SAMSUNG ELECTRONICS CO., LTD., Suwon-si (KR)

(72) Inventors: Dongik Lee, Suwon-si (KR); Dongwoon Lim, Suwon-si (KR); Jeomgap Kim, Suwon-si (KR); Sungjong Kim, Suwon-si (KR); Jeonggi Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 269 days.

(21) Appl. No.: 17/712,369

(22) Filed: Apr. 4, 2022

(65) Prior Publication Data

US 2022/0251759 A1 Aug. 11, 2022

Related U.S. Application Data

(63) Continuation of application No. PCT/KR2022/001988, filed on Feb. 9, 2022.

(30) Foreign Application Priority Data

Feb. 10, 2021 (KR) ..... 10-2021-0019101
May 28, 2021 (KR) ..... 10-2021-0068970

(51) Int. Cl.
*D06F 39/02* (2006.01)
*D06F 23/04* (2006.01)
*D06F 37/12* (2006.01)

(52) U.S. Cl.
CPC ..... *D06F 39/022* (2013.01); *D06F 23/04* (2013.01); *D06F 37/12* (2013.01)

(58) Field of Classification Search
CPC ..... D06F 39/022; D06F 23/04; D06F 37/12
USPC ..... 68/12.18
See application file for complete search history.

(56) References Cited

U.S. PATENT DOCUMENTS

| | | | |
|---|---|---|---|
| 3,085,417 | A | 4/1963 | Oles |
| 3,091,108 | A | 5/1963 | Martin et al. |
| 4,118,957 | A | 10/1978 | Marcussen |
| 4,478,059 | A | 10/1984 | Yates |
| 4,656,844 | A | 4/1987 | Mulder et al. |
| 5,033,277 | A | 7/1991 | Khan |
| 5,044,178 | A | 9/1991 | Altnau, Sr. |

(Continued)

FOREIGN PATENT DOCUMENTS

| | | |
|---|---|---|
| JP | 60-256492 | 12/1985 |
| JP | 2015-80559 | 4/2015 |

OTHER PUBLICATIONS

JPS60256492A—machine translation (Year: 1985).*

(Continued)

*Primary Examiner* — Tinsae B Ayalew
(74) *Attorney, Agent, or Firm* — STAAS & HALSEY LLP

(57) ABSTRACT

A washing machine which includes a tub, a drum rotatably inside the tub, a pulsator rotatable inside the drum at a bottom of the drum, and an agitator to be connected to an upper portion of the pulsator, where the agitator includes an agitator body, a rinse case to be installed in the agitator body, and to accommodate a rinse, the rinse case being detachable from the agitator body, and a plate spaced from the rinse case along a downward direction of the rinse case, and located lower than a maximum water level of water to be supplied to the tub.

15 Claims, 10 Drawing Sheets

(56) References Cited

U.S. PATENT DOCUMENTS

| | | | | |
|---|---|---|---|---|
| 5,113,542 | A | 5/1992 | Pastryk et al. | |
| 5,193,361 | A | 3/1993 | Singh et al. | |
| 5,359,744 | A | 11/1994 | Kimball et al. | |
| 5,500,967 | A * | 3/1996 | Wilson | D06F 39/024 68/17 A |
| 5,531,081 | A | 7/1996 | Savkar et al. | |
| 7,069,752 | B2 | 7/2006 | Clark et al. | |
| 10,151,058 | B2 | 12/2018 | Carpenter et al. | |
| 2004/0016267 | A1 | 1/2004 | Clark et al. | |
| 2009/0293203 | A1 | 12/2009 | Hettinger et al. | |

OTHER PUBLICATIONS

PCT/ISA/210 dated Jun. 9, 2022 in International Patent Application No. PCT/KR2022/001988 (3 pages).
Extended European Search Report dated Dec. 6, 2023 in European Patent Application No. 22752984.9.

* cited by examiner

WASHING MACHINE

CROSS REFERENCE TO THE RELATED APPLICATION

This application is a continuation application, under 35 U.S.C. § 111(a), of international application No. PCT/KR2022/001988, filed Feb. 9, 2022, which claims priority to Korean patent application No. 10-2021-0019101, filed Feb. 10, 2021 and Korean patent application No. 10-2021-0068970, filed May 28, 2021, the entire disclosures of all of which are herein incorporated by reference as a part of this application.

BACKGROUND

Field

The present disclosure relates to a washing machine, and more particularly, to a washing machine having an improved rinse case structure.

Description of the Related Art

A washing machine is a home appliance for washing clothes by using power, and includes a tub storing washing water, a drum rotatably installed inside the tub, and a driver for rotating the drum to wash laundry.

Washing machines are classified into agitator type washing machines, pulsator type washing machines, and drum washing machines according to washing methods. The agitator type washing machine performs washing by stirring laundry with washing water by an agitator protruding from the inner center of the drum. The pulsator type washing machine performs washing by rotating laundry and washing water by a pulsator rotatably installed on the inner bottom of the drum. The drum type washing machine performs washing by repeatedly performing operation of rotating the drum to lift laundry up and drop it down.

In general, agitator type washing machines and pulsator type washing machines belong to a top loading type into which laundry is put from the top, and drum washing machines belong to a front loading type into which laundry is put from the front.

A washing machine performs washing through a washing course, a midway dehydrating course, a rinsing course, and a final dehydrating course.

Meanwhile, in the case of the agitator type washing machine, a rinse case is provided in the agitator, and a rinse stored in the rinse case is discharged to the drum by a centrifugal force during a midway dehydrating course. At this time, the rinse discharged to the drum may be lost together with washing water by operation of the drainage system. That is, there is a problem that, when a rinse is lost before a rinsing course starts, a rinse is not appropriately supplied to laundry during the rinsing course.

SUMMARY

A washing machine according to an embodiment of the present disclosure includes: a tub; a drum rotatable inside the tub; a pulsator rotatable inside the drum at a bottom of the drum; and an agitator to be connected to an upper portion of the pulsator. According to an embodiment, the agitator includes: an agitator body; a rinse case to be installed in the agitator body and accommodate a rinse, the rinse case being detachable from the agitator body; and a plate spaced from the rinse case along a downward direction of the rinse case and located lower than a maximum water level of water to be supplied to the tub.

The washing machine may further include a discharge hole provided in a center portion of first plate.

According to an embodiment, the washing machine a first plate and a second plate where the second plate is formed to extend outward along a radial direction of the rinse case from an outer surface of the rinse case between an upper end portion and a lower end portion of the rinse case, and at least one communication hole formed in an area from which the second plate is formed to extend.

An auxiliary chamber may be formed between the first plate and the second plate.

The agitator may further include a cap provided in an upper portion of the rinse case, and the cap may include: an opening through which the rinse enters the rinse case; and a cylindrical part formed to extend along a downward direction of the opening and positioned adjacent to an outer side of the rinse case.

The washing machine may further include a guide flow path defined by the rinse case, the cylindrical part, and the second plate, to guide the rinse as the rinse is being discharged from the rinse case to the auxiliary chamber.

The washing machine may further include a gap formed between the cap and the rinse case so that the rinse accommodated in the rinse case enters the guide flow path.

The rinse accommodated in the rinse case may enter the gap along an inner side wall of the rinse case by a centrifugal force during a midway dehydrating course, the rinse enters the at least one communication hole from the gap along the guide flow path, and the rinse entering in the at least one communication hole may be accommodated in the auxiliary chamber.

The rinse accommodated in the auxiliary chamber may be discharged through the discharge hole when the midway dehydrating course is finished.

The pulsator may communicate with the agitator body, and include a plurality of inlet holes communicating with the drum, and a rinse discharged from the auxiliary chamber through the discharge hole may be supplied to the drum through the plurality of inlet holes.

Before the rinse discharged from the rinse case enters the auxiliary chamber, the rinse may accommodated in the guide flow path for a predefined time.

A washing machine according to an embodiment of the present disclosure includes: a tub; a drum rotatable inside the tub; a pulsator rotatable inside a bottom of the drum; and an agitator to be connected to an upper portion of the pulsator, wherein the agitator includes: an agitator body; a rinse case to be installed in the agitator body and form a primary storage space to accommodate a rinse; an upper plate formed to extend outward along a radial direction of the rinse case from an outer surface of the rinse case; and a lower plate spaced from the upper plate and to form a discharge hole in a center portion, wherein the lower plate is located lower than a maximum water level of water to be supplied to the tub.

A second storage space may be formed between the upper plate and the lower plate.

The washing machine may include at least one communication hole formed between the outer surface of the rinse case and the upper plate.

A rinse accommodated in the primary storage space may be discharged out of the primary storage space by a centrifugal force during a midway dehydrating course, and the discharged rinse may enter the secondary storage space through the at least one communication hole.

The rinse entered the secondary storage space may be pressed against an inner wall of the agitator body corresponding to the secondary storage space by a centrifugal force during the midway dehydrating course.

The rinse entered the secondary storage space may be discharged out of the secondary storage space through the discharge hole when the midway dehydrating course is finished.

The pulsator may communicate with the agitator body, and include a plurality of inlet holes communicating with the drum.

A washing machine according to an embodiment of the present disclosure includes: a tub; a drum rotatable inside the tub; a pulsator rotatable inside a bottom of the drum; and an agitator formed to extend along an upward direction of the pulsator, wherein the agitator includes: an agitator body; a rinse case to be installed in the agitator body and accommodate a rinse, the rinse case being detachable from the agitator body; an upper plate formed to extend outward along a radial direction of the rinse case from an outer surface of the rinse case; and a lower plate spaced from the upper plate to form an auxiliary chamber to accommodate the rinse discharged from the rinse case by a centrifugal force, wherein the lower plate forms a discharge hole in a center portion.

The lower plate may be located lower than a maximum water level of water that is supplied to the tub.

BRIEF DESCRIPTION OF DRAWINGS

The above and/or other aspects of the disclosure will be more apparent by describing certain embodiments of the disclosure with reference to the accompanying drawings, in which.

DETAILED DESCRIPTION

Figure 1:
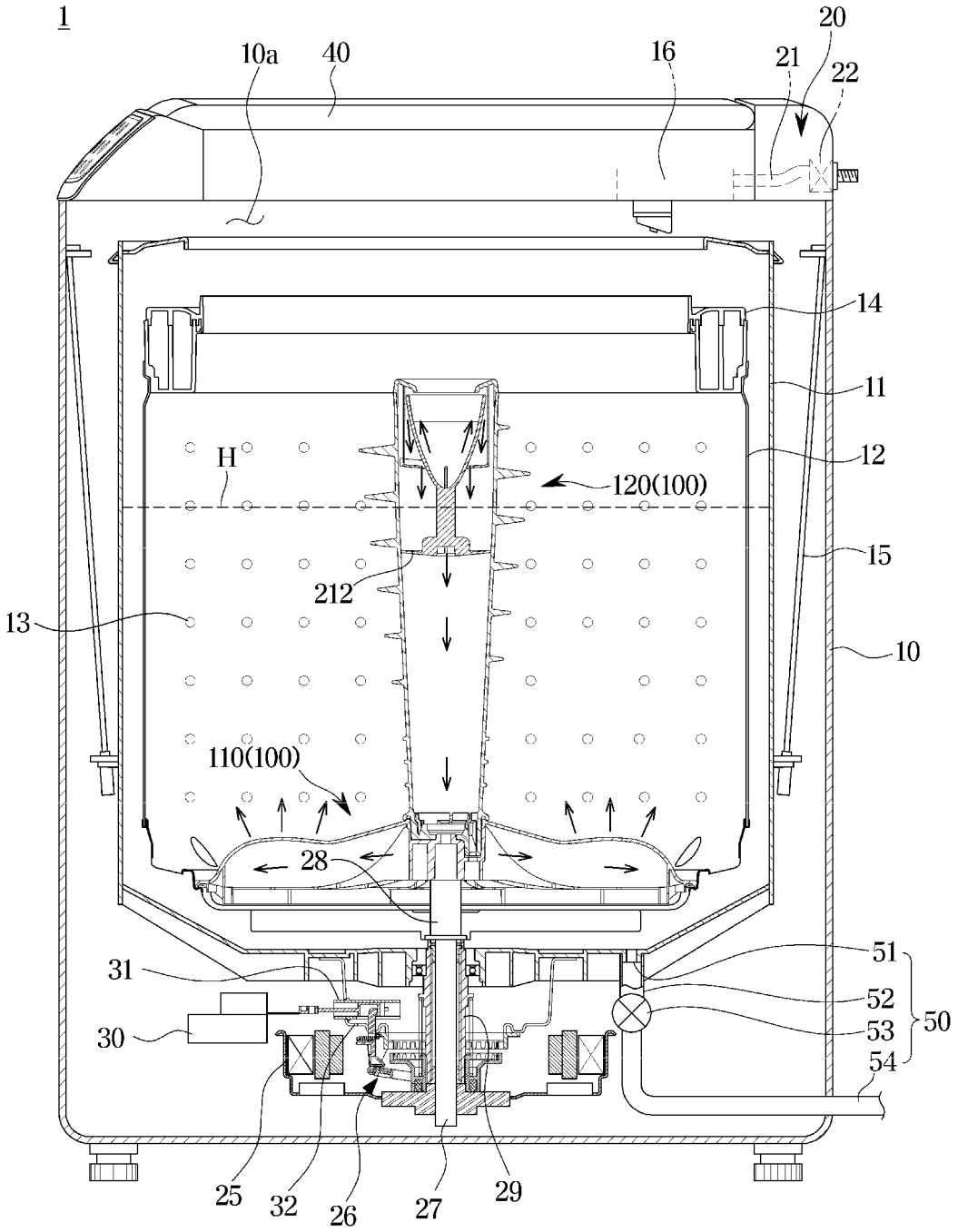
FIG. 1 is a cross-sectional view of a washing machine according to an embodiment of the disclosure.

Embodiments described in the specification and configurations illustrated in the drawings are merely preferred examples of the embodiments of the disclosure, and may be modified in various different ways at the time of filing of the present application to replace the embodiments and drawings of the specification.

Also, like reference numerals or symbols denoted in the drawings of the present specification represent members or components that perform the substantially same functions.

The terms used in the present specification are merely used to describe embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

In the following description, the terms "up-down direction", "upper end", "lower end", "upper portion", "lower portion", "upper side", "lower side", etc. are defined based on the drawings, and the shapes and positions of the corresponding components are not limited by the terms.

An aspect of the present disclosure provides a washing machine which is capable of preventing a rinse from being lost by a centrifugal force during a midway dehydrating course.

Another aspect of the present disclosure provides a washing machine in which a rinse is appropriately supplied to a drum after a midway dehydrating course is finished.

Still another aspect of the present disclosure provides a washing machine which is capable of preventing a rinse from remaining inside an agitator.

According to an embodiment of the present disclosure, a washing machine may prevent a rinse from being lost during a midway dehydrating course.

According to an embodiment of the present disclosure, a washing machine may improve a fabric softening effect by supplying a rinse to a drum after a midway dehydrating course is finished.

According to an embodiment of the present disclosure, a washing machine may suppress coagulation of a rinse, mold formation, etc. by preventing a rinse from remaining inside an agitator.

In the present specification, a rinse may be a material that is supplied to laundry during a rinsing course to softly detangle the laundry washed and prevent static electricity of the laundry, and may be the generic term for a conditioner, a fabric softener, an additive, a softener, etc.

Hereinafter, embodiments of the present disclosure will be described in detail with reference to the accompanying drawings.

Figure 2:
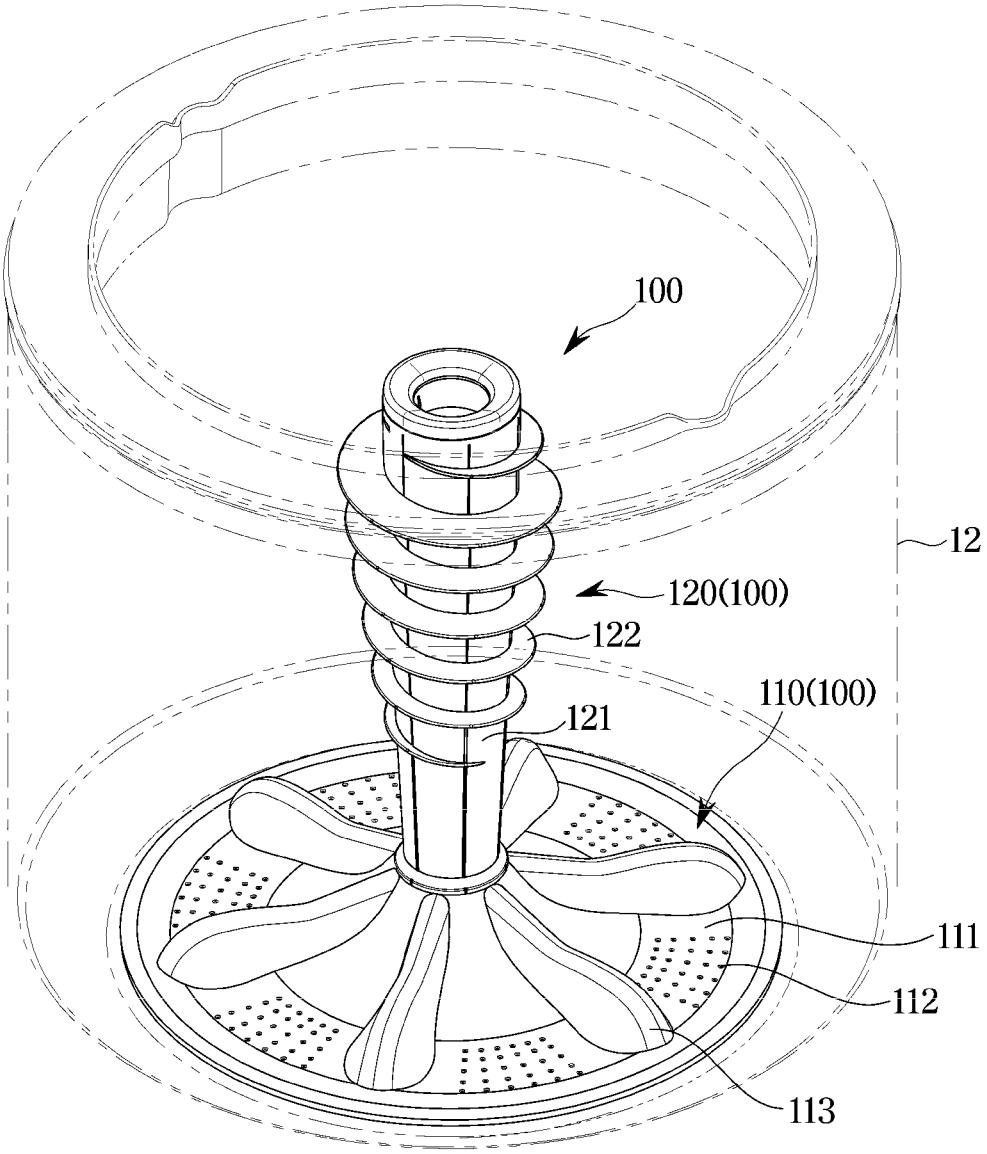
FIG. 2 is a perspective view showing an internal structure of a washing machine according to an embodiment of the disclosure.

FIG. 1 is a cross-sectional view of a washing machine according to an embodiment of the disclosure. FIG. 2 is a perspective view showing an internal structure of a washing machine according to an embodiment of the disclosure.

As shown in FIGS. 1 and 2, a washing machine 1 may include a cabinet 10, a tub 11 installed inside the cabinet 10, and a drum 12 rotatably positioned inside the tub 11.

Also, the washing machine 1 may further include a stirring device 100 for stirring laundry with water supplied to inside of the washing machine 1. The stirring device 100 may be provided inside the drum 12 to generate a stream of water. Water supplied to the inside of the washing machine 1 may be used for washing, and indicate both washing water that is supplied during a washing course and rinsing water that is supplied during a rinsing course. For example, the washing water may be water mixed with a detergent, and the rising water may be water containing no detergent. However, when a detergent is directly supplied to the inside of the drum 12, the washing water may be water containing no detergent.

The cabinet 10 may form an outer appearance of the washing machine 1, and may be substantially in a shape of a rectangular parallelepiped. In an upper portion of the cabinet 10, an opening 10*a* may be formed to put laundry to the inside of the drum 12 or take laundry out of the drum 12. On an upper surface of the cabinet 10, a door 40 may be provided to open or close the opening 10*a*. For example, the door 40 may be rotatably coupled with the cabinet 10 by hinge coupling.

The tub 11 may be positioned vertically inside the cabinet 10. The tub 11 may include a space in which washing water (or rinsing water) is stored. That is, the tub 11 may accommodate a certain amount of washing water (or rinsing water). For example, the tub 11 may include a cylinder shape of which an upper portion opens.

The tub 11 may be supported in the cabinet 10 by a suspension device 15. The suspension device 15 may attenuate vibrations generated in the tub 11.

Above the tub 11, a water supply device 20 for supplying washing water (or rinsing water) to the tub 11 may be provided. The water supply device 20 may include a water supply pipe 21 connected to an external water supply source (not shown), and a water supply valve 22 for controlling water supply. One side of the water supply pipe 21 may be connected to the external water supply source, and the other side of the water supply pipe 21 may be connected to a detergent supply device 16. Water supplied through the water supply pipe 21 may be supplied to the inside of the tub 11 together with a detergent via the detergent supply device 16. However, the detergent supply device 16 may be not an indispensable configuration, and therefore, water supplied through the water supply pipe 21 may be directly supplied to the inside of the tub 11 without passing through the detergent supply device 16.

Below the tub 11, a drainage device 50 for discharging water stored in the tub 11 and used for washing may be provided. More specifically, the drainage device 50 may include a drain outlet 51 formed in a bottom of the tub 11, a first drain pipe 52 along which washing water discharged from the drain outlet 51 flows, a drain valve 53 for controlling drainage through the first drain pipe 52, and a second drain pipe 54 connected to an exit of the drain valve 53 to discharge washing water to outside.

The drum 12 may be rotatable inside the tub 11. Also, a central axis of the drum 12 may be aligned with a central axis of the tub 11.

The drum 12 may accommodate laundry put through the opening 10*a*. For example, the drum 12 may include a hollow cylinder shape. In a side of the drum 12, a plurality of dehydrating holes 13 may be formed. During a dehydrating course, the drum 12 may rotate at high speed in one direction to apply a centrifugal force to laundry. At this time, the laundry may be pressed against an inner wall of the drum 12 by the centrifugal force, and water of the laundry may be separated from the laundry and discharged to the tub 11 through the dehydrating holes 13. The water discharged through the dehydrating holes 13 may be drained to the outside of the washing machine 1 by operation of the drainage device 50.

In a top end of the drum 12, a balancer 14 may be installed to cause the drum 12 to rotate stably at high speed. The balancer 14 may cancel an unbalanced load of the drum 12 to stabilize a rotation of the drum 12 at an early stage. For example, the balancer 14 may be formed in a shape of a ring.

Below an outer side of the tub 11, a motor 25 that generates a driving force for rotating the drum 12 and the stirring device 100, and a power switching device 26 for transferring a driving force generated by the motor 25 to any one or both of the drum 12 and the stirring device 100 may be installed.

A hollow dehydrating shaft 29 may be coupled with the drum 12, and a washing shaft 27 installed in a hollow space of the dehydrating shaft 29 may be coupled with the stirring device 100 through a washing shaft coupling portion 28. The motor 25 may transfer a driving force to any one or both of the drum 12 and the stirring device 100 according to operation of the power switching device 26.

The power switching device 26 may include an actuator 30 for generating a driving force for power switching, a rod portion 31 for linearly moving according to operation of the actuator 30, and a clutch portion 32 connected to the rod portion 31 to rotate according to operation of the rod portion 31.

Figure 3:
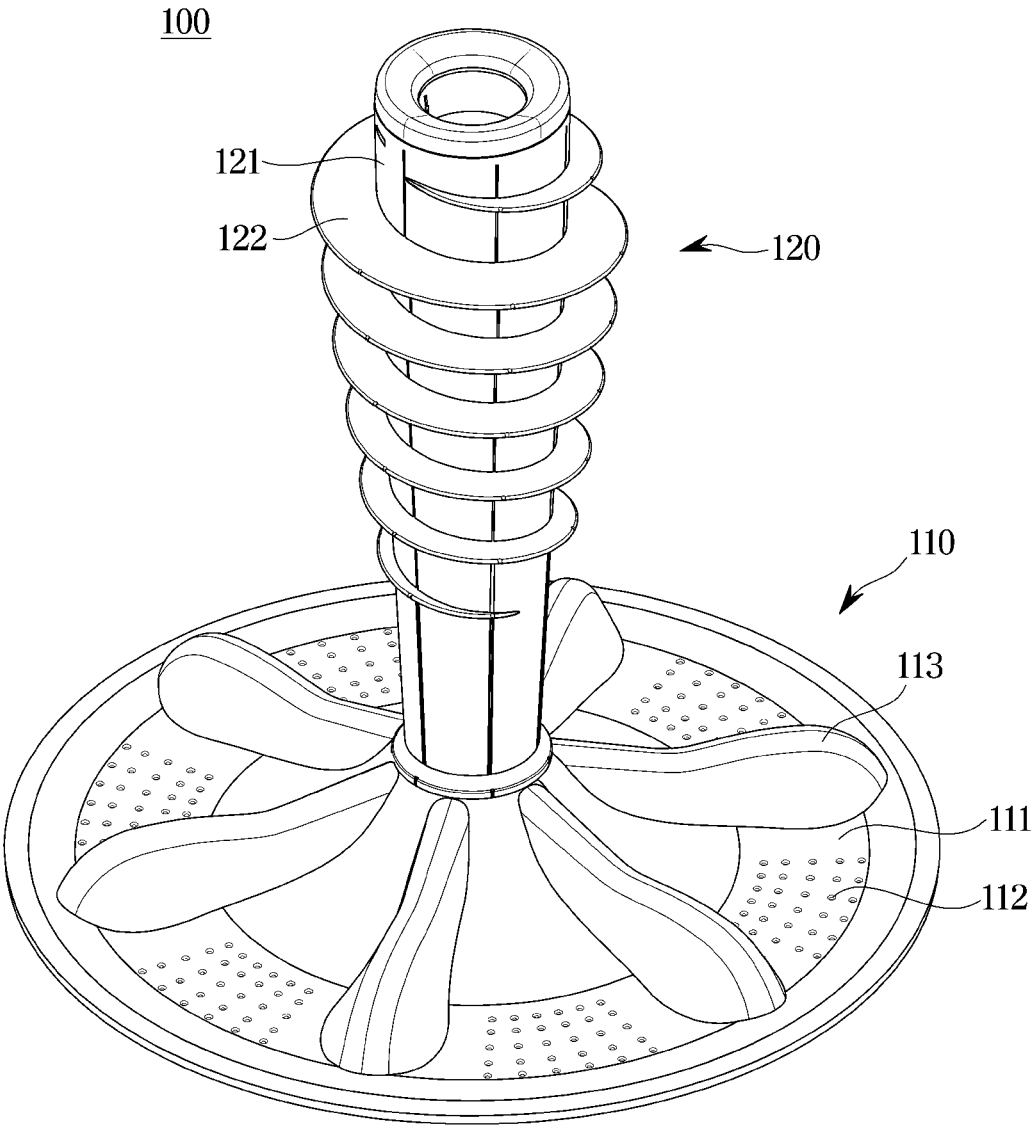
FIG. 3 is a perspective view showing a stirring device of a washing machine according to an embodiment of the disclosure.
Figure 4:
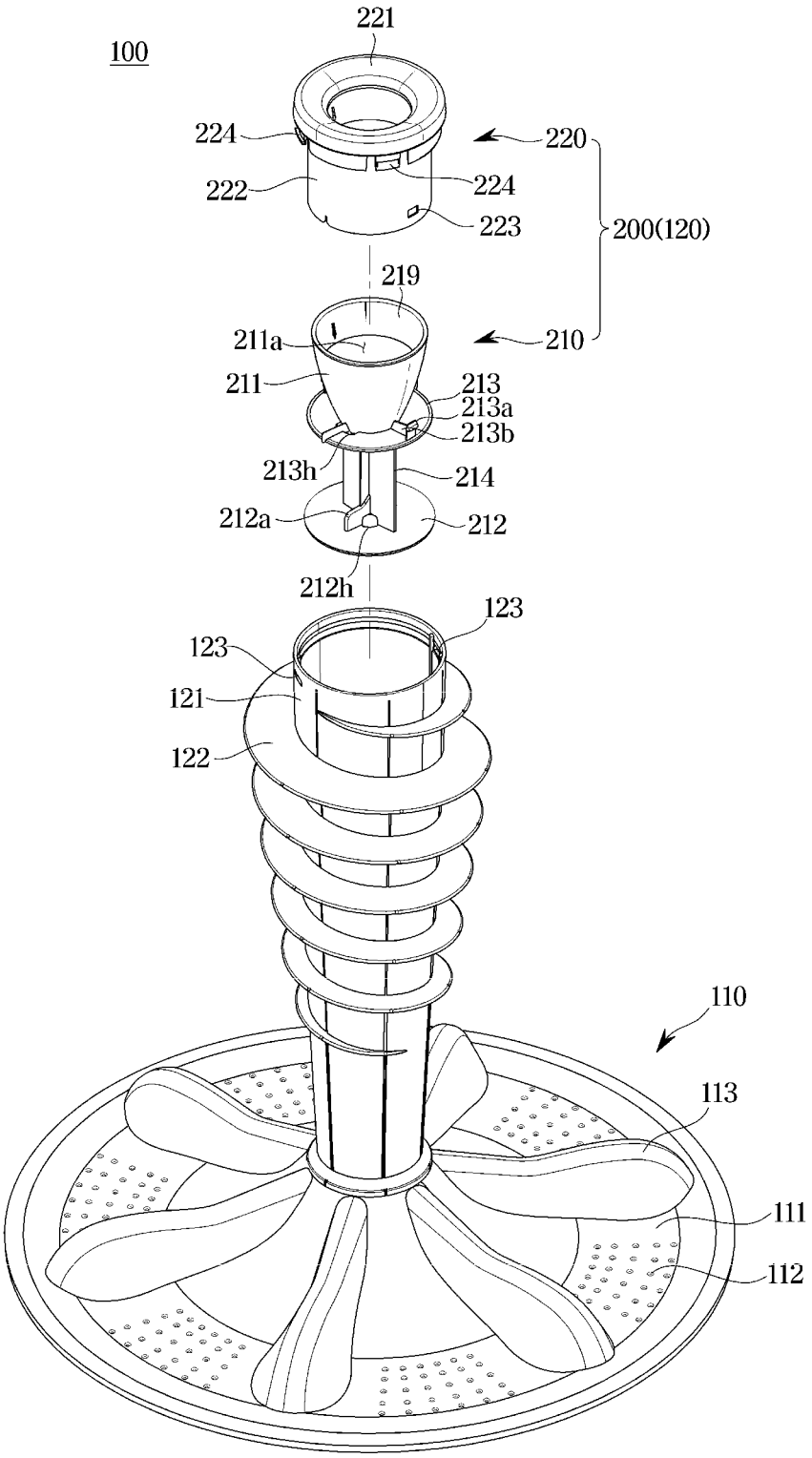
FIG. 4 is an exploded view of the stirring device shown in FIG. 3.

FIG. 3 is a perspective showing a stirring device of a washing machine according to an embodiment of the disclosure. FIG. 4 is an exploded view of the stirring device shown in FIG. 3.

Referring to FIGS. 1 to 4, the washing machine 1 may further include the stirring device 100 for stirring laundry with washing water (or rinsing water). The stirring device 100 may generate a stream of water by rotating forward or backward inside the drum 12. Laundry accommodated inside the drum 12 may be stirred with washing water by a stream of water generated by the stirring device 100 and washed by a friction. Also, the laundry accommodated inside the drum 12 may be stirred with rinsing water by a stream of water generated by the stirring device 100 and rinsed.

The stirring device 100 may include a base 110, and a tower 120 extending upward from the base 110. Hereinafter, the base 110 is also referred to as a pulsator, and the tower 120 is also referred to as an agitator.

The pulsator 110 may be rotatably provided in a lower portion of the drum 12 to generate a stream of water. More specifically, the pulsator 110 may be rotatably provided on an inside bottom of the drum 12.

The pulsator 110 may include a pulsator body 111, and at least one body blade 113 protruding from an upper side of the pulsator body 111.

The pulsator body 111 may be rotatably installed on the inside bottom of the drum 12. The pulsator body 111 may be formed substantially in a shape of a circular plate. The body blade 113 of the pulsator 110 may be provided as a plurality of body blades 113 having the same shape, and the plurality of body blades 113 may be spaced and arranged at regular intervals in a circumferential direction of the pulsator body 111.

Inside the pulsator body 111, a second discharge flow path 160 may be provided. The second discharge flow path 160 may communicate with a first discharge flow path 150 formed inside an agitator body 121 which will be described below. Also, the second discharge flow path 160 may communicate with the drum 12 through a plurality of inlet holes 112 which will be described below. A rinse entered from the agitator 120 may flow along the second discharge flow path 160. At this time, the rinse existing on the second discharge flow path 160 may be sufficiently diluted as rinsing water is filled into the pulsator body 110 during a rinsing course, instead of directly entering the drum 12, and then enter the drum 12 through the plurality of inlet holes 112. That is, because a rinse is not directly applied onto laundry (for example, cloth, etc.) accommodated in the drum 12, damage to laundry may be minimized, and a fabric softening effect may increase.

Also, in the pulsator body 111, the plurality of inlet holes 112 may be formed. The plurality of inlet holes 112 may be formed along an edge in circumferential direction of the pulsator body 111. The plurality of inlet holes 112 may communicate with the drum 12, and a rinse entered from the agitator 120 may be supplied to the drum 12 through the plurality of inlet holes 112.

The agitator 120 may suppress tangling of laundry during a washing process by forming a stream of water in a left-right direction and a stream of water in an up-down direction. Also, the agitator 120 may improve a washing effect by striking laundry.

The agitator 120 may be connected to an upper portion of the pulsator 110. The agitator 120 may be rotatably coupled with the upper portion of the pulsator 110. The agitator 120 may be detachably installed in the pulsator 110. The agitator 120 may stand upright in a center of the pulsator 110.

The agitator 120 may include an agitator body 121 and an agitator blade 122 protruding from an outer surface of the agitator body 121.

The agitator body 121 may be connected to the upper portion of the pulsator 110, and be rotatable inside the drum 12. The agitator body 121 may include a shape extending in the up-down direction, and for example, the agitator body 121 may include a rod shape. The agitator body 121 may include a shape with a smaller cross section at the lower portion.

Also, the agitator body 121 may include a hollow shape, and communicate with the pulsator body 111. Inside the agitator body 121, the first discharge flow path 150 may be provided. A rinse may flow along the first discharge flow path 150, and enter the pulsator 110. More specifically, a rinse may flow along the first flow path 150, and enter the second discharge flow path 160 provided inside the pulsator body 111. The first discharge flow path 150 may communicate with the second discharge flow path 160.

The agitator blade 122 may protrude from an outer circumference surface of the agitator body 121, and improve a friction of laundry. For example, the agitator blade 122 may be provided in a spiral shape.

Figure 5:
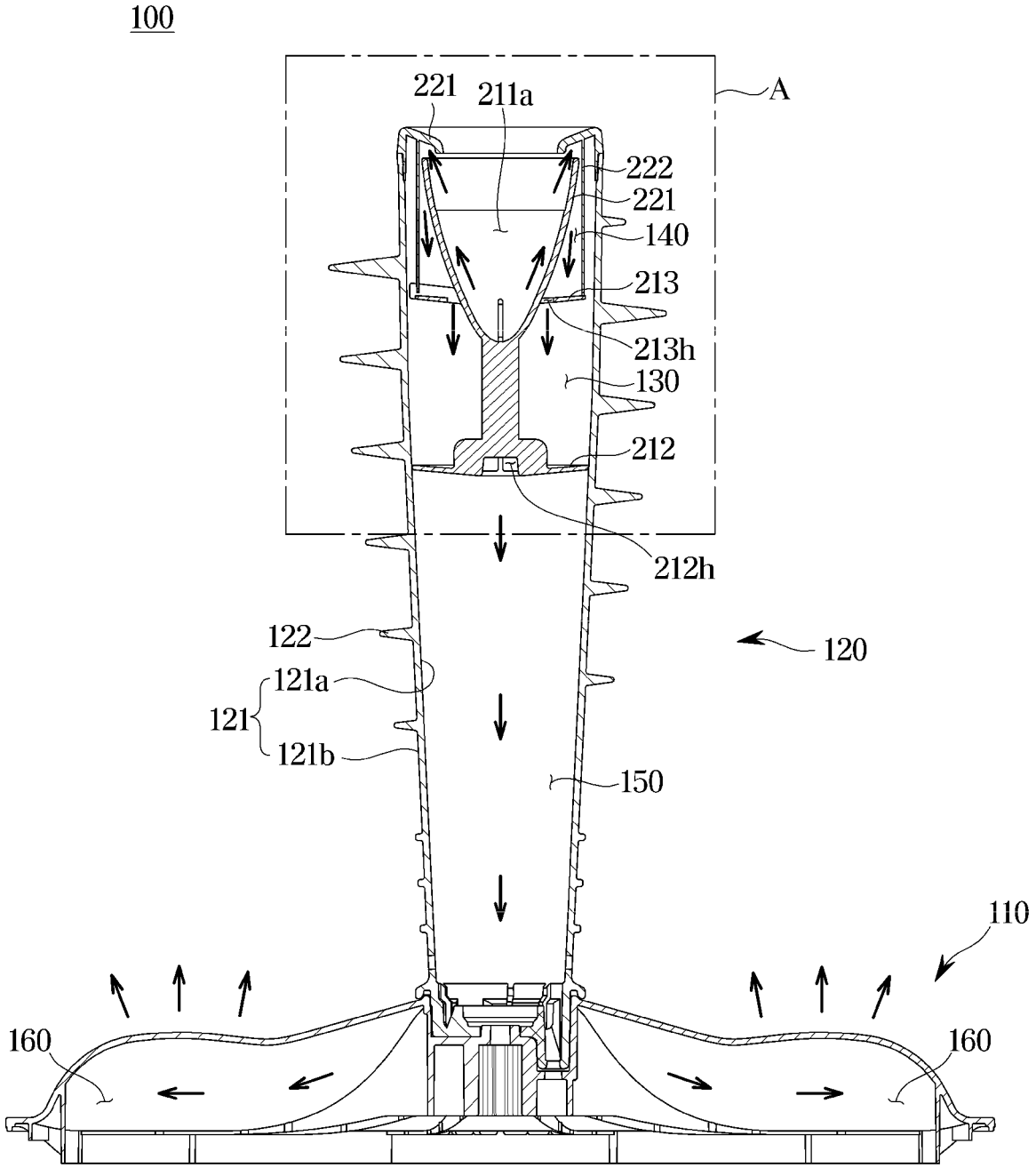
FIG. 5 is a cross-sectional view of the stirring device shown in FIG. 3.
Figure 6:
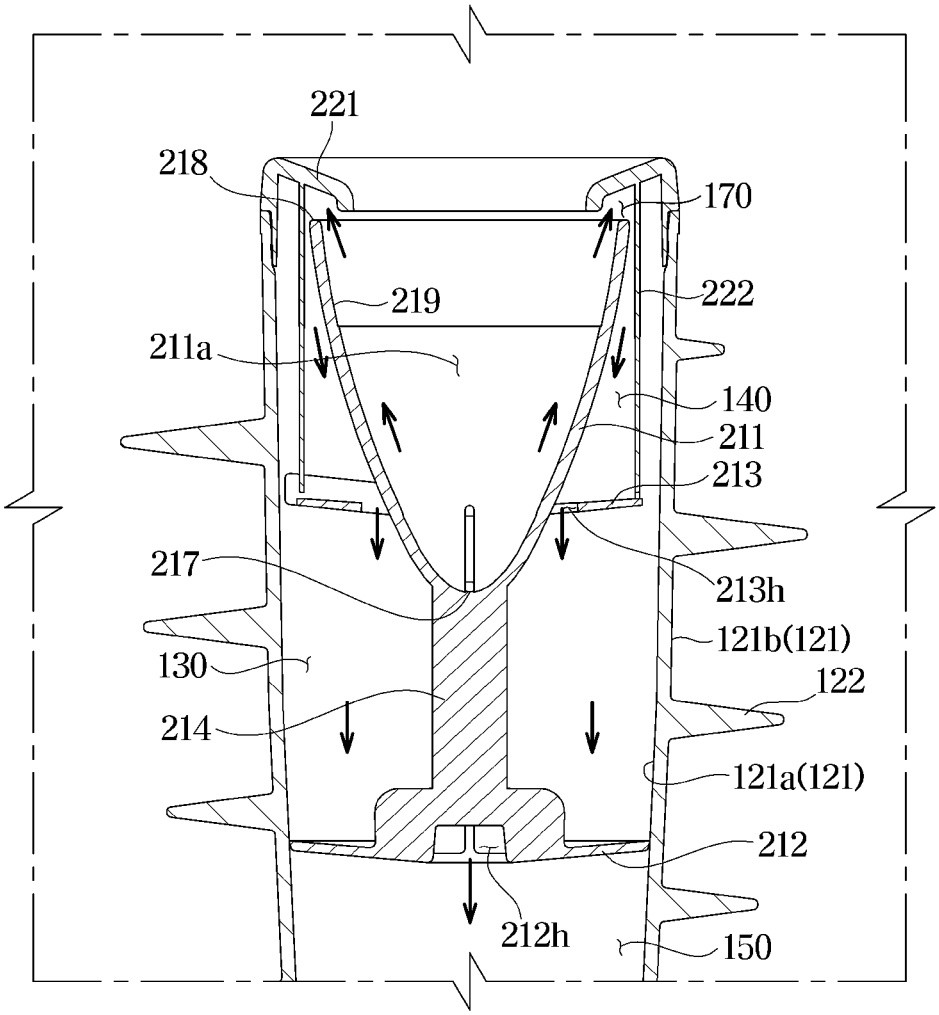
FIG. 6 is an enlarged view of a part A of FIG. 5.
Figure 7:
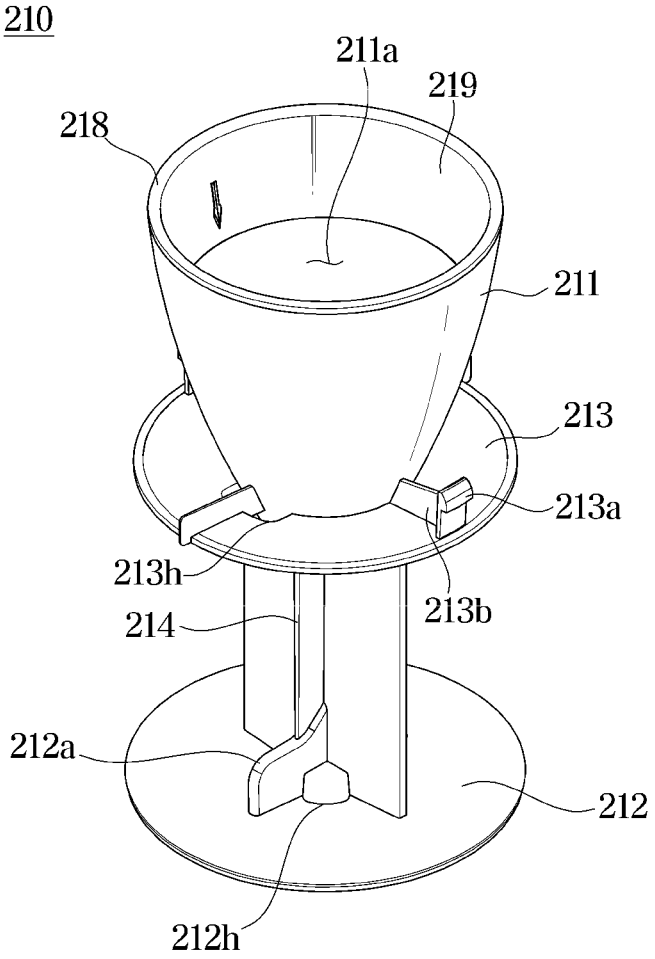
FIG. 7 is a perspective view showing a dispensing container of a washing machine according to an embodiment of the disclosure.
Figure 8:
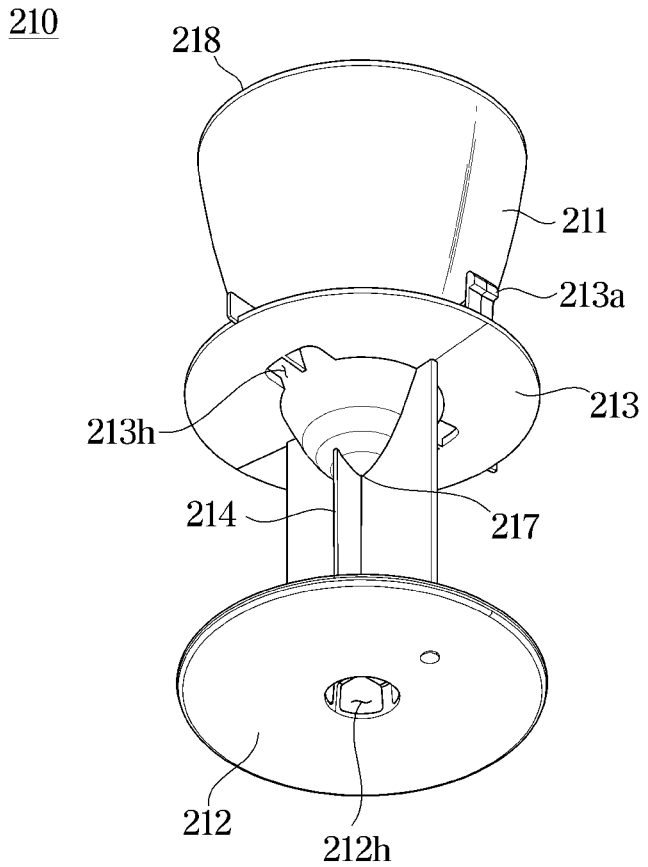
FIG. 8 is a bottom perspective view of the dispensing container shown in FIG. 7.
Figure 9:
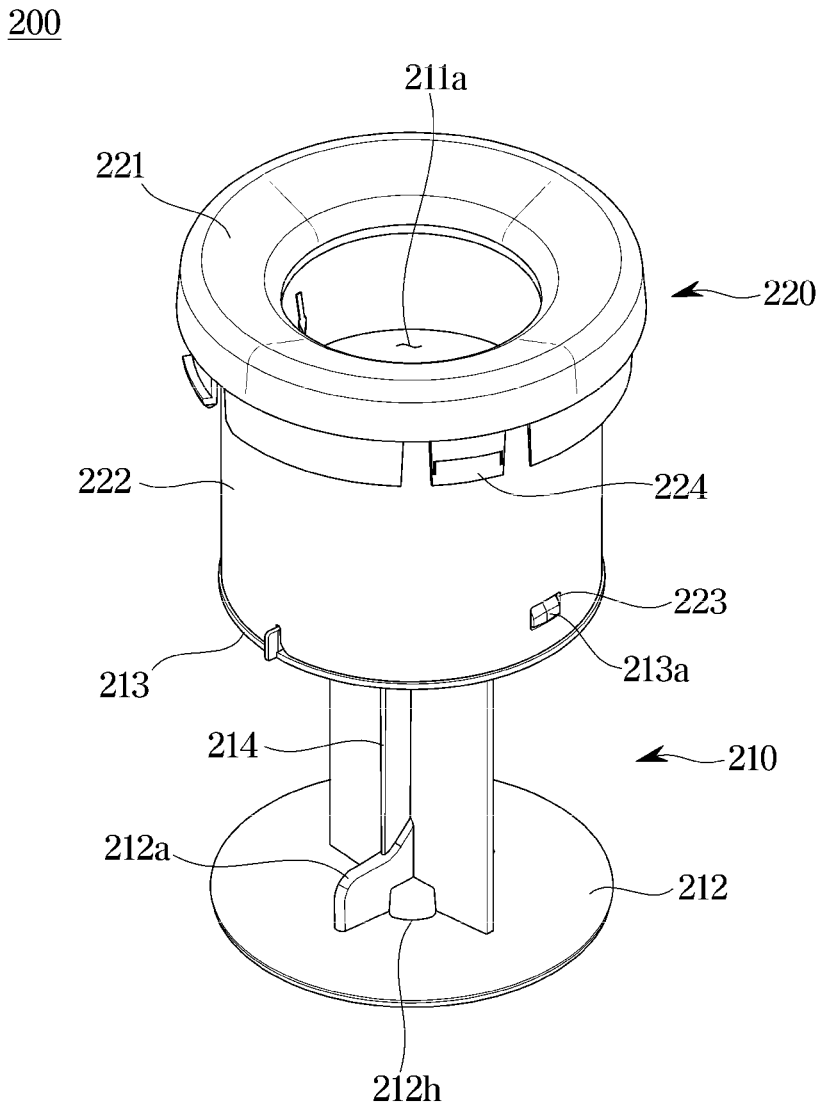
FIG. 9 is a perspective view showing a rinse dispenser of a washing machine according to an embodiment of the disclosure.
Figure 10:
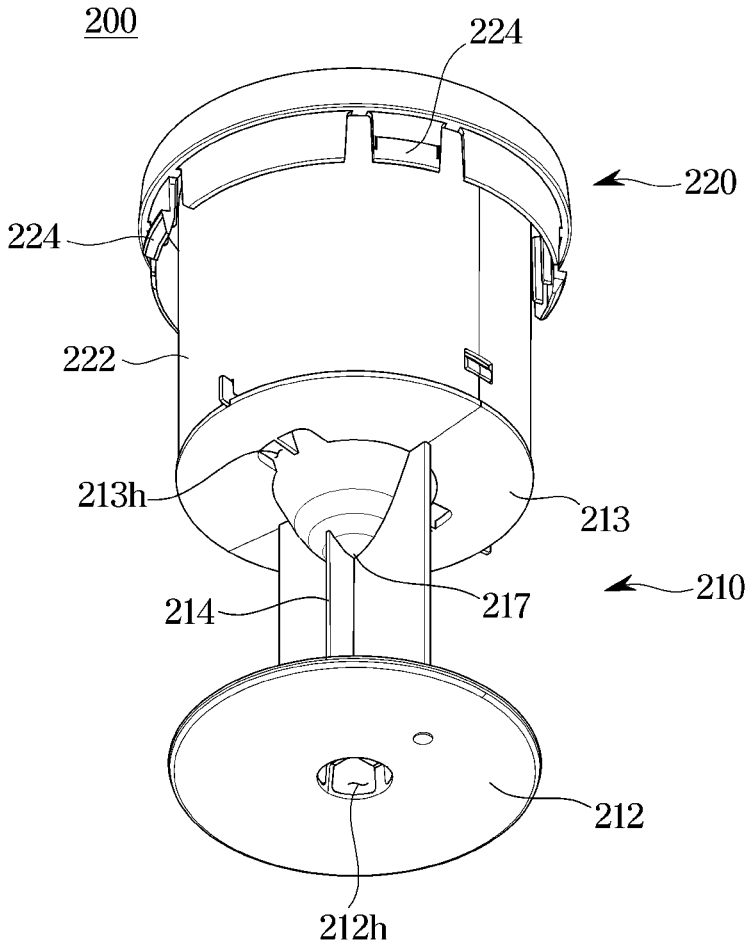
FIG. 10 is a bottom perspective view of the rinse dispenser shown in FIG. 9.

FIG. 5 is a cross-sectional view of the stirring device shown in FIG. 3. FIG. 6 is an enlarged view of a part A of FIG. 5. FIG. 7 is a perspective view showing a dispensing container of a washing machine according to an embodiment of the disclosure. FIG. 8 is a bottom perspective view of the dispensing container shown in FIG. 7. FIG. 9 is a perspective view showing a rinse dispenser of a washing machine according to an embodiment of the disclosure. FIG. 10 is a bottom perspective view of the rinse dispenser shown in FIG. 9.

Referring to FIG. 4, the agitator 120 may include a rinse dispenser 200 for supplying a rinse to the inside of the drum 12. The rinse dispenser 200 may be installed in the agitator body 121. For example, at least one portion of the rinse dispenser 200 may be installed in the agitator body 121 by being inserted into an inside upper portion of the agitator body 121. More specifically, the rinse dispenser 200 may include a dispensing container 210 and a dispensing cap (hereinafter, referred to as a cap) 220.

The dispensing container 210 may include a rinse case 211. The rinse case 211 may be detachably installed in the agitator body 121. Also, the rinse case 211 may be positioned inside the agitator body 121. The rinse case 211 may be a receiver storing a rinse, and form a primary storage space 211*a*. For example, a user may put a rinse into the primary storage space 211*a* of the rinse case 211 before operating the washing machine 1. A top of the rinse case 211 may open to receive a rinse. For example, the rinse case 211 may be formed in a shape of a certain cup, and a cross section of the rinse case 211 may include a parabolic shape.

Referring to FIGS. 5 and 6, a first plate 212 may be spaced from the rinse case 211. More specifically, the first plate 212 may be spaced downward from the rinse case 211. Also, the first plate 212 may include a disc shape.

For example, the first plate 212 may be inserted into an inner surface of the agitator body 121. That is, an outer circumference of the first plate 212 may correspond to an inner side surface of the agitator body 121, and accordingly, the first plate 212 may be stably rested inside the agitator body 121.

Meanwhile, referring to FIG. 1, the first plate 212 may be located lower than a maximum water level H of water (for example, washing water or rinsing water) that is supplied to the tub 11. Details about this will be described in the related part, below.

Also, in a center portion of the first plate 212, a discharge hole 212*h* may be provided. A rinse accommodated in an auxiliary chamber 130 which will be described below may enter the first discharge flow path 150 through the discharge hole 212*h* due to a RPM reduction of the agitator 120 when a midway dehydrating course is finished. At this time, to smoothly discharge the rinse, the center portion of the first plate 212 may be concave.

Referring to FIG. 4, for example, the first plate 212 may include at least one rib 212*a* protruding upward to extend to a connecting portion 214 which will be described below.

A second plate 213 may extend outward in the radial direction of the rinse case 211 from an outer surface of the rinse case 211. More specifically, the second plate 213 may extend outward in the radial direction of the rinse case 211 from the outer surface of the rinse case 211 between an upper end 218 and a lower end 217 of the rinse case 211. Also, at least one communication hole 213*h* may be formed between the second plate 213 and the outer surface of the rinse case 211. More specifically, the communication hole 213*h* may be formed in at least one part of an area from which the second plate 213 extends. Because a rinse enters the auxiliary chamber 130 which will be described below via the communication hole 213*h*, the rinse may be prevented from being agglomerated.

The second plate 213 may partition a guide flow path 140 which will be described below from the auxiliary chamber 130 by a predefined space. More specifically, the second plate 213 may partition the remaining space except for the part in which the communication hole 213*h* is formed, in a horizontal direction. Accordingly, because the second plate 213 can primarily hold a rinse discharged from the rinse case 211 in the guide flow path 140, a problem that a rinse is lost during a midway dehydrating course may be more definitely prevented.

The second plate 213 may include a first coupling protrusion 213*a* for coupling with the cap 220 which will be described below. More specifically, the first coupling protrusion 213*a* may be coupled with a first coupling groove 223 formed in a circumferential surface of the cap 220. For example, the first coupling protrusion 213*a* may extend upward from an upper surface of the second plate 213, and a predefined portion of the first coupling protrusion 213*a* may protrude outward. Also, at least one rib 213*b* may be provided between the first coupling protrusion 213*a* and the outer surface of the rinse case 211.

Meanwhile, the first plate 212 is also referred to as a lower plate, and the second plate 213 is also referred to as an upper plate.

As shown in FIGS. 5 and 6, the auxiliary chamber 130 may be formed between the first plate 212 and the second plate 213. The auxiliary chamber 130 may be a space defined by the first plate 212, the second plate 213, and an inner wall 121*a* of the agitator body 121. The agitator body 121 may include the inner all 121*a* and an outer wall 121*b*.

The auxiliary chamber 130 may be a secondary storage space, and may be a space accommodating a rinse such that the rinse is not lost during a midway dehydrating course. More specifically, the auxiliary chamber 130 may accommodate a rinse discharged from the primary storage space 211*a* by a centrifugal force during a midway dehydrating course.

The connecting portion 214 may connect the first plate 212 to the second plate 213. More specifically, one end of the connecting portion 214 may be connected to the first plate 212, and the other end of the connecting portion 214 may be connected to the second plate 213. For example, the connecting portion 214 may include a shape extending vertically in the up-down direction. The rinse case 211, the first plate 212, the second plate 213, and the connecting portion 214 may be integrated into one body, although not limited thereto. However, the rinse case 211, the first plate 212, the second plate 213, and the connecting portion 214 may be manufactured as separate component parts and then assembled.

The agitator 120 may further include the cap 220 provided in an upper portion of the rinse case 211. For example, upper and lower portions of the cap 220 may open. Also, the cap 220 may include an opening 221 through which a rinse is put, and a cylindrical part 222 extending downward from the opening 221. In a state in which the dispensing container 210 is coupled with the cap 220, the cylindrical part 222 may be positioned adjacent to an outer side of the rinse case 211.

The cap 220 may be coupled with an upper end portion of the agitator body 121. More specifically, the opening 221 of the cap 220 may include a second coupling protrusion 224. The second coupling protrusion 224 may extend downward, and a predefined portion of the second coupling protrusion 224 may protrude outward. The second coupling protrusion 224 may be coupled with a second coupling groove 123 formed at the upper end portion of the agitator body 121.

Also, as shown in FIGS. 9 and 10, the cap 220 may be coupled with the dispensing container 210. The cap 220 may include the first coupling groove 223. More specifically, in the cylindrical part 222 of the cap 220, the first coupling groove 223 corresponding to the first coupling protrusion 213*a* of the second plate 213 may be provided. The first coupling groove 223 may be coupled with the first coupling protrusion 213*a* of the second plate 213. For example, when the first coupling protrusion 213*a* is coupled with the first coupling groove 223, a lower end portion of the cylindrical part 222 may be in contact with an upper surface of the second plate 213.

To guide a rinse discharged from the rinse case 211 to the auxiliary chamber 130, the guide flow path 140 may be provided. The guide flow path 140 may be formed by the rinse case 211, the circumferential surface 222, and the second plate 213. More specifically, in a state in which the dispensing container 210 is coupled with the cap 220, the guide flow path 140 may be a space defined by the outer surface of the rinse case 211, an inner surface of the cylindrical part 222, and the upper surface of the second plate 213. Meanwhile, a rinse discharged from the rinse case 211 may be hold in the guide flow path 140 for a predefined time. Thereby, the rinse may be more definitely prevented from being lost.

Also, to cause a rinse accommodated in the rinse case 211 to enter the guide flow path 140, a gap 170 may be formed between the rinse case 211 and the cap 220. More specifically, the gap 170 may be a space provided between the upper end 218 of the rinse case 211 and the opening 221 of the cap 220.

Meanwhile, because a rinse generally has viscosity, a rinse may remain inside the agitator 120 (particularly, the inner wall 121*a* of the agitator) when the rinse is supplied and/or put. Due to the remaining rinse, the rinse may be solidified (coagulated) inside the agitator 120 to form a foreign material such as mold, etc. Accordingly, fatal problems, such as contamination of laundry or a bad smell from laundry, may be generated. Particularly, a certain portion (the upper portion in which the rinse dispenser 200 is provided) of the agitator body 121 may be washed to some degree by separating the cap 220, however, washing the remaining portion (for example, the middle and lower portions) which a user's hand does not reach without using a separate tool may be very difficult. More specifically, in a state in which the dispensing container 210 is installed in the agitator body 121, a rinse may be easily coagulated and/or molds may be easily reproduced in an area below the first plate 212 provided in the agitator body 121.

To overcome the problem, the first plate 212 may be located lower than the maximum water level H of water (for example, washing water or rinsing water) that is supplied to the tub 11. For example, by securing a predefined water level of washing water (or rinsing water), it may be possible to maximally prevent a rinse from remaining inside the agitator 120. Particularly, because there is high probability that a rinse will remain in the area below the first plate 212, a level of washing water may be secured preferentially to a location of the first plate 212. More specifically, when water is supplied, washing water may be filled in the inside of the agitator body 121, and accordingly, a remaining rinse may be partially dissolved. During a washing course, the remaining rinse may be removed by a friction with water, generated by a rotation of the agitator 120. As a result, the rinse remaining inside the agitator 120 may be easily washed away.

For example, when a washing course, a midway dehydrating course, a rinsing course, and a final dehydrating course form a washing cycle, a first cycle may be defined as a preceding washing cycle, and a second cycle may be defined as a following cycle. During a rinsing course of the first cycle, a rinse may be put into the drum 12. At this time, when the rinse is put, the rinse may remain on the inner wall 121*a* of the agitator body 121. However, because the first plate 212 is located lower than the maximum water level H of washing water, washing water may be filled to a higher location than that of the first plate 212. Accordingly, the rinse remaining on the inner wall 121*a* of the agitator body 121 may be washed away by washing water supplied to the tub 11 during a washing course of the following second cycle. As a result, problems (for example, mold formation, a bad smell, etc.) that may be generated according to a remaining rinse and solidification of a rinse, etc. may be easily solved.

The maximum water level H of washing water may be at any location that is higher than the location of the first plate 212, without being limited according to relations with other components except for the first plate 212. In FIG. 1, the maximum water level H of washing water is shown to be lower than the lower end 217 of the rinse case 211, however, this is only exemplary. The maximum water level H of washing water may be located higher than the lower end 217 of the rinse case 211. For example, the maximum water level H of washing water may be located between the first plate 217 and the second plate 213, or higher than the second plate 213.

Successively, a rinse discharge process will be described with reference to FIGS. 5 and 6.

As the RPM of the stirring device 100 increases during a midway dehydrating course of the washing machine 1, a centrifugal force may be applied to the agitator 120. A rinse accommodated in the primary storage space 211*a* of the rinse case 211 may move to an upper portion of the rinse case 211 along an inner side wall 219 of the rinse case 211 by the centrifugal force. The rinse moved to the upper portion of the rinse case 211 may enter the gap 170 provided in the upper portion of the rinse case 211. That is, a rinse accommodated in the rinse case 211 may pass through the gap 170 and then be discharged out of the rinse case 211.

The rinse passed through the gap 170 may be accommodated in the guide flow path 140 provided outside the rinse case 211. The second plate 213 may partition the guide flow path 140 from the auxiliary chamber 130 by a predefined space. The rinse discharged from the rinse case 211 may be hold in the guide flow path 140 for a predefined time by the second plate 213, without directly entering the auxiliary chamber 130. That is, the rinse discharged from the rinse case 211 may be primarily accommodated in the guide flow path 140 before entering the auxiliary chamber 130. Accordingly, a problem that a rinse is lost during a midway dehydrating course may be more definitely prevented.

The rinse accommodated in the guide flow path 140 may enter the auxiliary chamber 130 via the communication hole 213*h*. Due to application of a centrifugal force during a midway dehydrating course, the rinse accommodated in the auxiliary chamber 130 may rotate in the state of being adjacent to the inner wall of the agitator body 121. That is, because the rinse accommodated in the auxiliary chamber 130 rotates along an outer edge of the auxiliary chamber 130, the rinse may be not discharged out of the auxiliary chamber 130 through the discharge hole 212*h* provided in the center portion of the first plate 212. In other words, when the agitator 120 is maintained at preset RPM during a midway dehydrating course, a rinse accommodated in the auxiliary chamber 130 may be not discharged out of the dispensing container 210. Accordingly, a problem that a rinse is discharged in advance into the drum 12 during a midway dehydrating course and thus lost by the drainage device 50 (specifically, a drainage pump (not shown)) may be prevented.

When the midway dehydrating course is finished, the RPM of the agitator 120 may be reduced. Accordingly, the rinse accommodated in the auxiliary chamber 130 may stop rotating gradually and flow to the center portion of the first plate 212. Accordingly, the rinse may be discharged out of the auxiliary chamber 130 through the discharge hole 212*h*.

The rinse discharged through the discharge hole 212*h* may flow along the first discharge flow path 150 provided inside the agitator body 121. More specifically, the rinse may move downward along the first discharge flow path 150, and enter the second discharge flow path 160 provided inside the pulsator body 111. During a rinsing course, when water (rinsing water) is supplied to the inside of the tub 11, the inside of the stirring device 100 may also be filled with water. At this time, the rinse accommodated in the second discharge flow path 160 may be sufficiently diluted with the water. The diluted rinse may be supplied to the inside of the drum 12 through the plurality of inlet holes 112.

Through the above-described process, a rinse may be not lost during a midway dehydrating course. Also, when a rinsing course is performed after the midway dehydrating course is finished, a sufficiently diluted rinse may be applied onto laundry, thereby improving a fiber softening effect.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A washing machine comprising:
- a tub;
- a drum rotatable inside the tub;
- a pulsator that is rotatable inside the drum while arranged at a bottom of the drum; and
- an agitator to be connected to an upper portion of the pulsator,
- wherein the agitator comprises:
  - an agitator body;
  - a rinse case to be installed inside an upper portion of the agitator body and to accommodate a rinse, the rinse case being detachable from the agitator body; and
  - a plate having a flat shape extending along a circumferential direction of the rinse case, the plate being arranged inside the upper portion of the agitator body and separated by a space from the rinse case along a downward direction of the rinse case,
  - wherein the plate includes a connecting portion protruding from an upper surface of the plate and connecting a bottom of the rinse case inside the space between the bottom of the rinse case, and the plate defines a maximum water level of water to be supplied to the tub during a washing course or a rinsing course of the washing machine.

2. The washing machine of claim 1, further comprising a discharge hole provided in a center portion of the plate.

3. The washing machine of claim 2, wherein the plate is a first plate and the washing machine further comprises a second plate formed to extend outward along a radial direction of the rinse case from an outer surface of the rinse case between an upper end portion and a lower end portion of the rinse case.

4. The washing machine of claim 3, further comprising at least one communication hole formed in an area from which the second plate is formed to extend.

5. The washing machine of claim 4, wherein an auxiliary chamber is formed between the first plate and the second plate.

6. The washing machine of claim 5, wherein the agitator further comprises a cap provided in an upper portion of the rinse case, wherein the cap comprises:

an opening through which the rinse enters the rinse case; and a cylindrical part formed to extend along a downward direction of the opening and positioned adjacent to an outer side of the rinse case.

7. The washing machine of claim 6, further comprising a guide flow path defined by the rinse case, the cylindrical part, and the second plate, to guide the rinse as the rinse is being discharged from the rinse case to the auxiliary chamber.

8. The washing machine of claim 7, wherein a gap is formed between the cap and the rinse case so that the rinse accommodated in the rinse case enters the guide flow path.

9. The washing machine of claim 8, wherein the rinse accommodated in the rinse case enters the gap along an inner side wall of the rinse case by a centrifugal force during a midway dehydrating course, the rinse enters the at least one communication hole from the gap along the guide flow path, and the rinse entering in the at least one communication hole is accommodated in the auxiliary chamber.

10. The washing machine of claim 9, wherein the rinse accommodated in the auxiliary chamber is discharged through the discharge hole when the midway dehydrating course is finished.

11. The washing machine of claim 5, wherein the pulsator communicates with the agitator body, and includes a plurality of inlet holes communicating with the drum, and a rinse discharged from the auxiliary chamber through the discharge hole is supplied to the drum through the plurality of inlet holes.

12. The washing machine of claim 7, wherein, before the rinse discharged from the rinse case enters the auxiliary chamber, the rinse is accommodated in the guide flow path for a predefined time.

13. The washing machine of claim 3, further comprising a primary storage space formed inside the rinse case, and a secondary storage space formed between the first plate and the second plate.

14. The washing machine of claim 13, wherein a rinse accommodated in the primary storage space is discharged out of the primary storage space by a centrifugal force during a midway dehydrating course, and the discharged rinse enters the secondary storage space.

15. The washing machine of claim 14, wherein the rinse that entered the secondary storage space is discharged out of the secondary storage space through the discharge hole when the midway dehydrating course is finished.

* * * * *